US005349796A

United States Patent [19]

Meyerson

[11] Patent Number: 5,349,796

[45] Date of Patent: Sep. 27, 1994

[54] BUILDING PANEL AND METHOD

[75] Inventor: Steven C. Meyerson, Clearwater, Fla.

[73] Assignee: Structural Panels, Inc., Oldsmar, Fla.

[21] Appl. No.: 811,822

[22] Filed: Dec. 20, 1991

[51] Int. Cl.[5] ..... E04B 1/80; E04B 7/00

[52] U.S. Cl. ..... 52/309.11; 52/309.9; 52/588.1; 52/589.1

[58] Field of Search ..... 52/309.9, 309.11, 588, 52/595, 588.1, 589.1

[56] References Cited

U.S. PATENT DOCUMENTS

| | | | |
|---|---|---|---|
| 3,295,278 | 1/1967 | Muhm | 52/309.11 |
| 3,386,218 | 6/1968 | Scott | 52/309.11 |
| 3,397,496 | 8/1968 | Sohns | 52/536 |
| 4,288,962 | 9/1981 | Kavanaugh | 52/309.11 |
| 4,640,074 | 2/1987 | Paakkinen | 52/309.11 |
| 4,649,680 | 3/1987 | Weisner et al. | 52/200 |
| 4,769,963 | 10/1991 | Meyerson | 52/404 |
| 4,936,078 | 6/1990 | Porter | 52/595 |
| 5,086,599 | 2/1992 | Meyerson | 52/309.9 |

*Primary Examiner*—Carl D. Friedman
*Assistant Examiner*—Christopher Todd Kent
*Attorney, Agent, or Firm*—Jack E. Dominik

[57] ABSTRACT

A panel which has a central insulating core, usually expanded polystyrene or equivalent material, which core is flanked on one side by a skin laminated to the core, and on the other side by a composite skin such as oriented strand board (OSB) or plywood such as five eighth plywood sheets is disclosed. The oriented strand board is more desirable because of its structure and more importantly its availability in lengths up to forty feet. The joint at the lateral edges is comparable to that of U.S. patent application Ser. No. 513,922 filed Apr. 24, 1990. On one side where there is a protrusion and an interlock with a groove. An extension and recess are provided but the same have a different configuration inasmuch as one has the board substrate is its side portion. In addition, a joiner is provided so that with an overlapping portion of the composite skin on the adjacent laterally disposed panel they will overlap at the middle of the joiner. Since the joiner is secured underneath its overlapping composite skin, simple stapling of the other forms a very tight joint and strengthens when used as a roof. Similarly as a wall, when the OSB or plywood portion is interior, the joint can be strengthened. Another aspect of the invention looks to the provision of a shear rail of the same or equivalent material as the composite skin which is positioned at a mid-station and optionally supplemented by another shear rail at another location in the panel. The shear rails run the length of the panel. This creates an I-beam like effect and permits the panel of a given core thickness to span significantly greater unsupported distances. It also provides for framing a drop in the skylight between parallel rails. The method of the invention looks to the assembly of panels of the type just described into roofs, walls, and building systems.

9 Claims, 5 Drawing Sheets

BUILDING PANEL AND METHOD

FIELD OF THE INVENTION

This invention relates to the subject matter of building panels which join at their lateral edges with an interlocking joint and have an exterior skin or substrate which sandwichingly engages an insulating core. The same are exemplified by applicant's U.S. Pat. Nos. 4,769,963 issued Sep. 13, 1988, and U.S. patent application Ser. No. 513,922 filed Apr. 24, 1990.

SUMMARY OF THE PRIOR ART

The summary of the prior art cannot be complete without referring to applicant's own prior patents and disclosures. They both essentially relate to a pair of skin members which sandwichingly engage a core. The skin is commercially formed of aluminum with roll-formed interlocking lateral edges on both sides of the core, and the core is usually an expanded polystyrene of a nominal three inch thickness although it can go to six inches where such applications are required. In the commercial embodiments of the prior art the skin on both sides is metallic and relatively thin, in the order of nineteen thousandths to thirty-two thousandths and primarily aluminum although steel has been run. Other sheet materials with comparable forming and joining properties are acceptable as well. The shaped lateral edges flank either a recess or an extension in the core in order that between adjacent panels an interlocking effect is achieved between the core members while the lateral edges of the skin form an interlock which holds the panels together without the need of nails or other joining elements. The panels work exceeding well but suffer from the disadvantage of not meeting building codes in certain areas where, after a wall or a roof is completed, a substrate of drywall or other material is required to meet fire code. An additional disadvantage is the inability to normally nail to the aluminum, which is particularly so when the aluminum skin panel is to be used as a shingled roof. More particularly, where the roof is an extension of the existing roof, and it is desired to shingle over the joint, the aluminum or metallic skin renders this difficult and, because of the nail penetrating the aluminum, the bond between the tar paper and shingles and the roof is less effective than when roofing over a normal plywood panel.

More specifically, the prior art not only includes applicant's U.S. Pat. No. 4,769,963 as originally issued, but as re-examined pursuant to the Certificate of Re-Examination No. BI 4,769,963 issued Sep. 10, 1991. In addition the prior art is exemplified in applicant's pending application Ser. No. 513,922 filed Apr. 24, 1990.

SUMMARY OF THE INVENTION

In broad outline the invention is directed to a panel in which it has a central insulating core, usually expanded polystyrene or equivalent material, which core is flanked on one side by a skin laminated to the core, and on the other side by a composite skin such as oriented strand board (OSB) or plywood such as five eighth plywood sheets. The oriented strand board is more desirable because of its structure and more importantly its availability in lengths up to twenty eight feet. The formed skin joint may be as illustrated applicant's U.S. patent application Ser. No. 513,922 filed Apr. 24, 1990. In addition a joiner is provided so that with an overlapping portion of the composite skin on the adjacent laterally disposed panel they will overlap at the middle of the joiner. Since the joiner is secured underneath its overlapping composite skin, simple stapling of the other forms a secure joint and strengthens when placed in use as a roof. Similarly as a wall, when the OSB or plywood portion is interior, the joint can be strengthened by stapling. Another aspect of the invention looks to the provision of one or more shear rails of the same or equivalent material as the composite skin which are positioned at a mid-station and optionally supplemented by another shear rail at another location in the panel. The shear rails run the length of the panel. This creates an I-beam like effect and permits the panel of a given core thickness to span significantly greater unsupported distances. It also provides for framing a drop in the skylight between parallel rails. The method of the invention looks to the assembly of panels of the type just described into roofs, walls, and building systems.

In view of the foregoing, it is a principle object of the present invention to provide a panel which has the advantage of a skin or metallic face on one side, and a nailable composite skin on the other side which permits it to be used as a roofing member which can be shingled in a conventional manner; and also permits it to be used as a wall which permits the easy attachment of drywall since nobody needs to look for studs and the drywall can be stapled in place to the substrate very quickly with unskilled labor.

Still another object of the present invention looks to the provision of a building panel which, because of one of the elements of the composite flanking the core, passes fire code in most communities and therefore renders it a viable construction alternative to two-by-four studding with plywood, blown or secured insulation, and the like.

Yet another object of the present invention looks to the provision of a panel which, with an interior nailable substrate can be readily laminated with a whole host of decorator laminates or, can be finished by sanding and painting, or indeed can be finished by overlaying with wall paper or similar overlays.

BRIEF DESCRIPTION OF THE DRAWINGS

Further objects and advantages of the present invention will become apparent as the following description of an illustrative embodiment proceeds, taken in conjunction with the accompanying drawings, in which.

DESCRIPTION OF A PREFERRED EMBODIMENT

Figure 1:
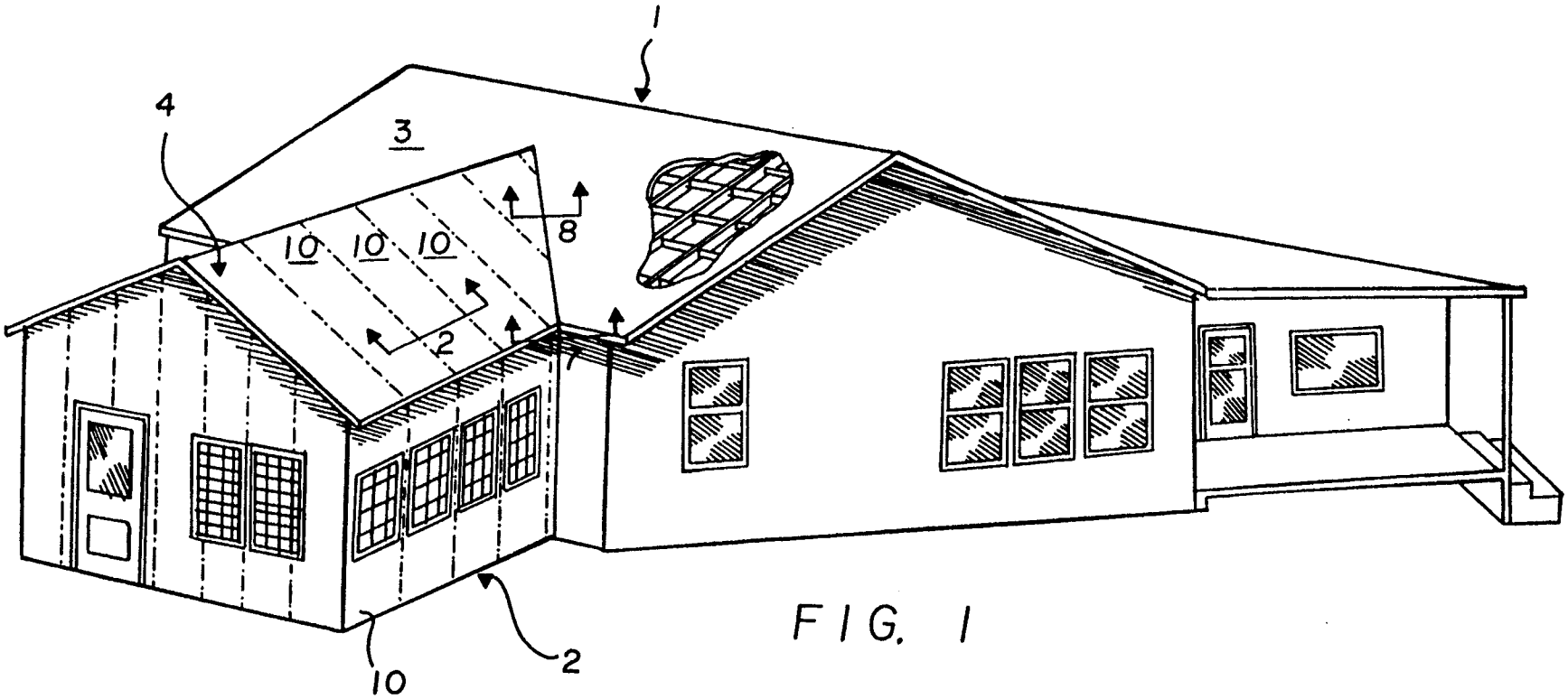
FIG. 1 is a perspective view of a residence having a room addition employing panels illustrative of the present invention.

The subject invention is, in a practical application, illustrated in FIG. 1 of the drawings. There it will be seen that a free standing house 1 is the subject of a room addition 2 utilizing the panels illustrative of the present invention. The house roof 3 is gabled, as well as the room addition roof 4.

Figure 8:
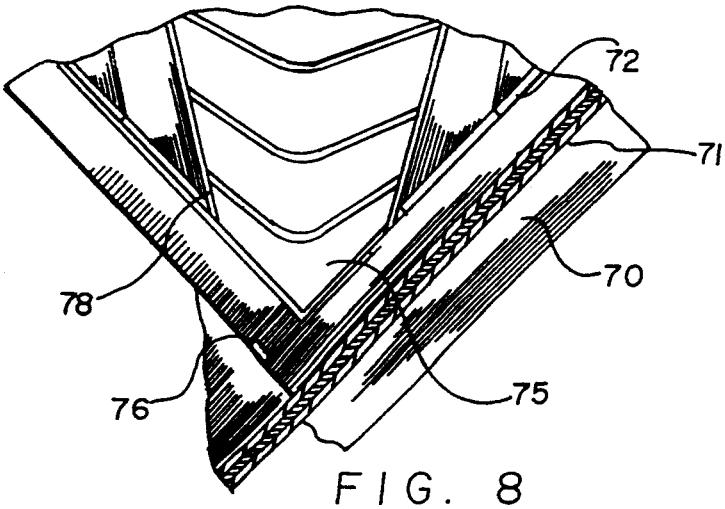
FIG. 8 is a perspective partially broken view of the roof gutter taken from vantage point 8 in FIG. 1.

The room addition 2, for its roof 4, sidewalls, and end walls utilize the building panel 10 illustrative of the present invention. The building panel 10, in turn, is illustrated in FIG. 8 where it will be seen that it has an edge extension 11, and an opposite edge recess 12. The panel 10 has a core 14 which normally is expanded polystyrene or equivalent structural insulating core material.

Figure 2:
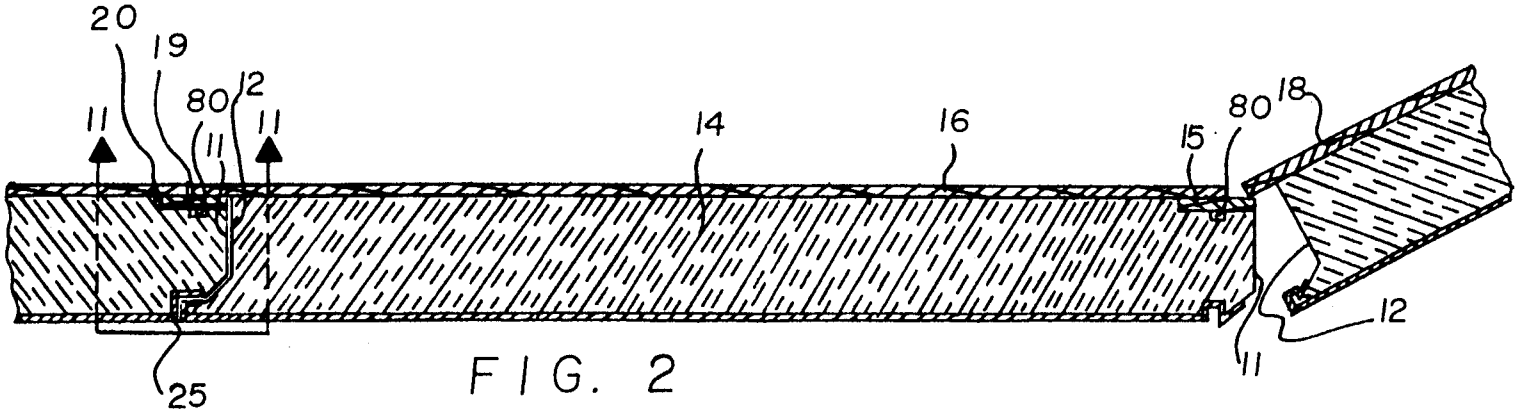
FIG. 2 is a transverse sectional view of adjacent panels in the course of assembly and taken along section line 2—2 of FIG. 1.
Figure 11:
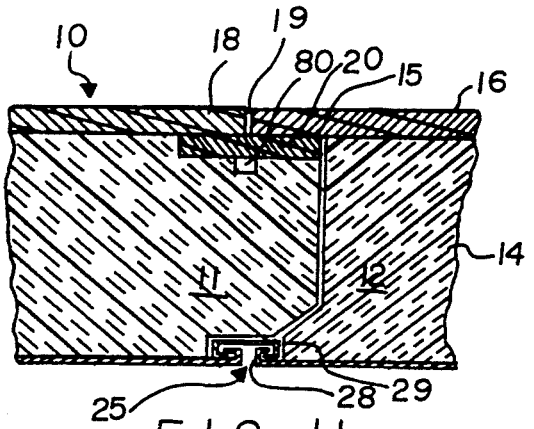
FIG. 11 is an enlarged view of the joint Shown by the reference numeral 10 and phantom lines in FIG. 2 and specifically illustrating the positioning of nails and staples between the overlap and the nailing strip aqnd showing an alternative embodiments interlocking joint.

As shown in FIG. 2, joiner 15 is provided at one lateral edge of the core 14, namely above the edge extension 11. A joiner overlap 18 is provided at the opposite edge of the core 14 which is an extension of the composite skin 16 which overlies the joiner 15 at one lateral edge by the edge extension 11, and extends over the overlap recess 21 of the edge recess 12. Desirably a gap 19 (see FIGS. 2 and 11) of one-eighth to one-half inch is provided between the lateral edge of the overlap 18 and the opposite skin 16 to provide for expansion and contraction. The joint 19 dimension also varies in accordance with humidity as well as temperature. Joiner interlocks 20 as shown in FIGS. 2 and 11, are desirably staples or can be nails. The overlap 18 may, prior to assembly, have a laminating glue-like material applied to the underneath portion, or alternatively, the laminating glue-like material may be applied to the upper portion of the adjacent joiner 15.

At the lower portion of the panel 10, opposite the composite skin 16, is a sheet 32. The sheet 32 terminates in lateral snap-lock elements 25 (see FIG. 2), illustrated here in the same form and content as applicant's patent application Ser. No. 513,922 filed Apr. 24, 1990. It will be understood, however, that other interlocking variables are available which will do an equivalent or lesser function, but still achieve a securement of the joint. Such a joint is shown in FIG. 11 where the lateral edges of the skin 32 are U-shaped. They are joined by a sliding cleat 29. Thus it is an interlock 25 which secures the adjacent panel skin portions that is required.

Figure 15:
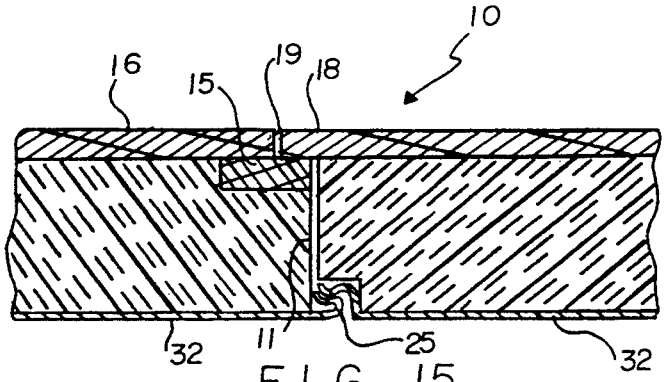
FIG. 15 is a broken view in cross-section of an alternative embodiment joint.
Figure 16:
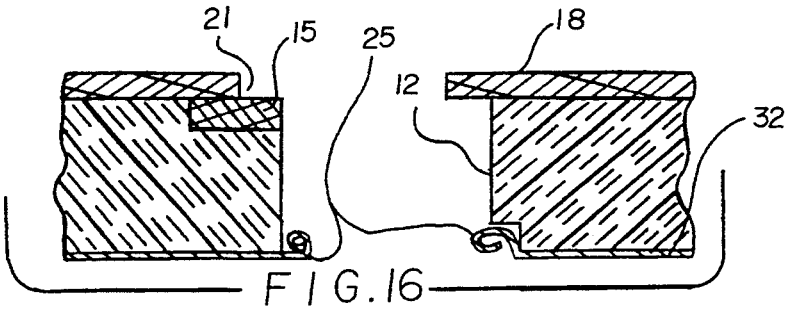
FIG. 16 is an exploded view of the alternative embodiment shown in FIG. 15 in reduced scale.

An alternative embodiment building panel 10′ is shown in FIG. 15 where it will be seen that the edge extension 11′ underlies the joiner 15′ which is beneath the composite exterior sheet 16′. Provision is made for a joiner overlap 18′ terminating at the joint 19′. The edge extension 11′ is at the left and the edge recess 12′ is at the right. The relationship between the edge extension 11′ and the recess 12′ is highlighted in FIG. 16. The interlock joiner 25′ may be any of the alternatives as shown.

Figure 17:
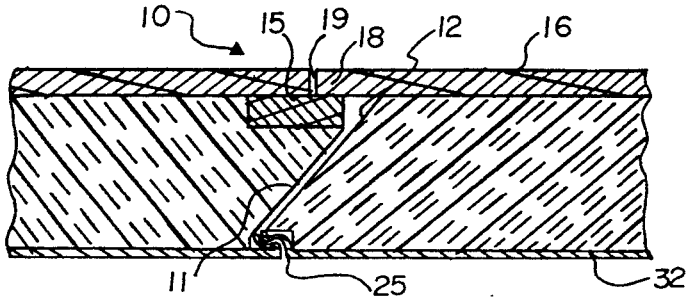
FIG. 17 is yet another alternative embodiment of the subject joint.
Figure 18:
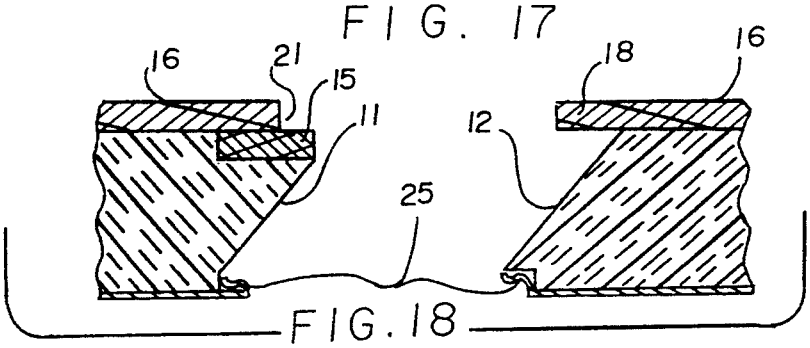
FIG. 18 is an exploded view of the joint shown in FIG. 17 in somewhat reduced scale.

A further alternative embodiment of the building panel 10″ is shown in FIG. 17. There it will be seen that the composite skin 16″ is placed on one side of the core material 14″, and a skin 32″ is on the opposite side with the lateral edges forming an interlock 25″. The joiner 15″ lies beneath the overlap 18″. The edge extension 11″ is angled and positioned directly beneath the joiner 15″. The edge recess 12″ also has an angled edge and is proportioned to matingly engage the extension 11″.

Figure 3:
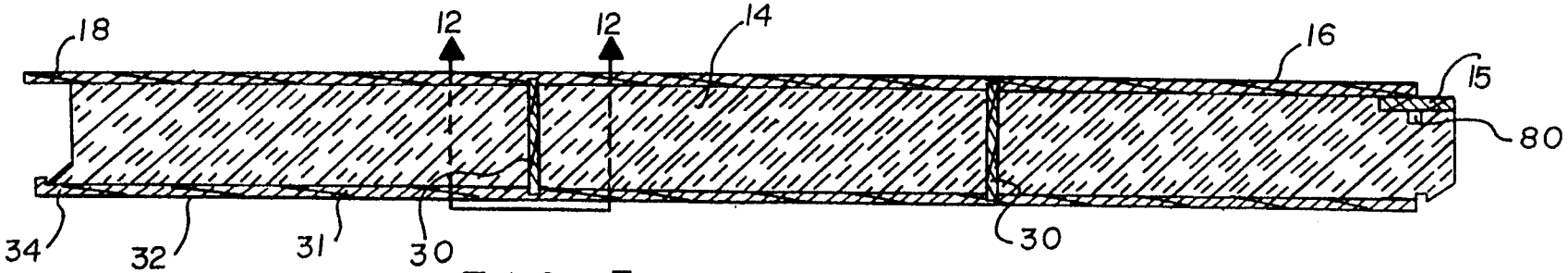
FIG. 3 is an alternative embodiment of FIG. 1 illustrating the use of reinforcing shear rails interiorly of the panel, otherwise being essentially the same as the panel shown in FIG. 2.
Figure 4:
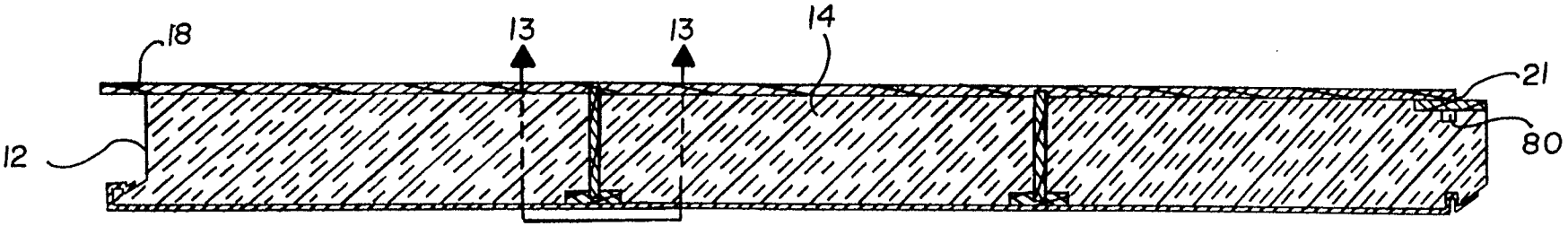
FIG. 4 is yet another version of an optional use of shear rails having footers.

In accordance with an option, the panels 10 may be constructed as shown in FIGS. 3 and 4. In FIG. 3 the skin or composite skin 16 is at the upper portion above the core 14, and the lower portion utilizes a thinner composite skin 34 which is covered by sheet 32. In this embodiment, as will be described hereinafter, the shear rails 30 are secured at their upper edges and lower edges in essentially the same fashion.

Figure 12:
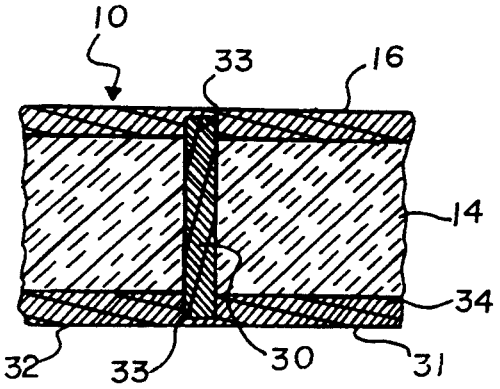
FIG. 12 is an enlarged view of the shear rails shown in the encircled portion of FIG. 3.

In the option shown in FIG. 4, the panel 10 is substantially identical to that of FIG. 3 with the exception that the underneath skin is a metallic or sheet formed skin without the composite underlying skin 24, and in addition, a footer 35 of composite material or equivalent is provided. In greater detail, the utilization of the shear rails 30 is better shown in FIGS. 12 and 13. There it will be seen that groove seats 33 are applied in the first option as shown in FIG. 12 which are cut in the composite skin 34. The groove seats 33 for the upper and lower portion of the shear rail 30 are essentially the same. In the option shown in FIG. 13, however, the groove seat 33 is at the upper edge of the shear rail 30, and provision is made for a shear rail seat in the form of footer 35 above where the footer 35 joins skin 32. A footer seat 36 receives the lower edge of the shear rail 35.

Figure 9:
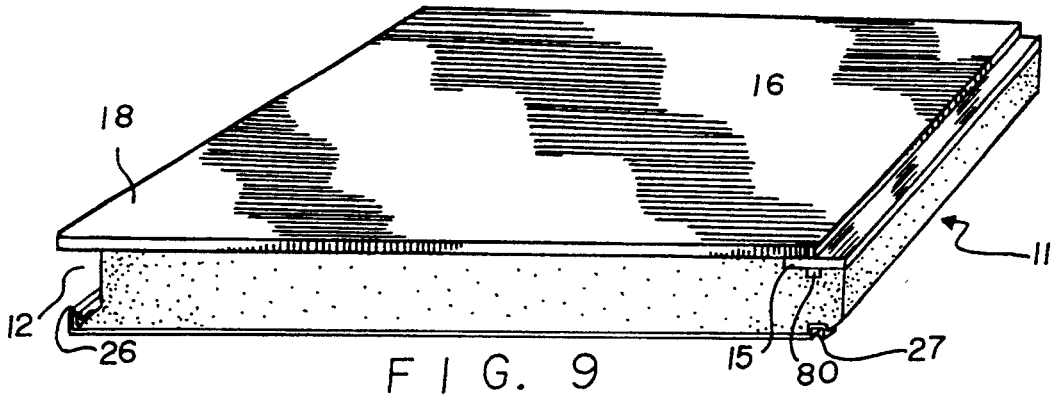
FIG. 9 is a perspective end view of the illustrative panel.

The end joints are shown in somewhat greater detail in FIG. 9 where it will be seen that a press 26 is provided adjacent the edge recess 12, and a groove 27 is provided adjacent the extended edge extension 11. This is substantially in conformance with the dimensions and proportions shown in applicant's patent application Ser. No. 513,922 filed Apr. 24, 1990.

An alternative construction interlock joint of the cleat variety is shown in FIG. 11. There it will be seen, that the ends of the skin 32 are reversely folded into a J-shaped cross-section 28. These abuttingly engage above the edge extension 11 and then are secured by means of a cleat 29 slipped over the joint. This alternative embodiment illustrates the necessity for an interlock opposite the joiner 15, but also the flexibility of the structure which permits a joint between the opposed skin member other than the snap acting variety.

Figure 19:
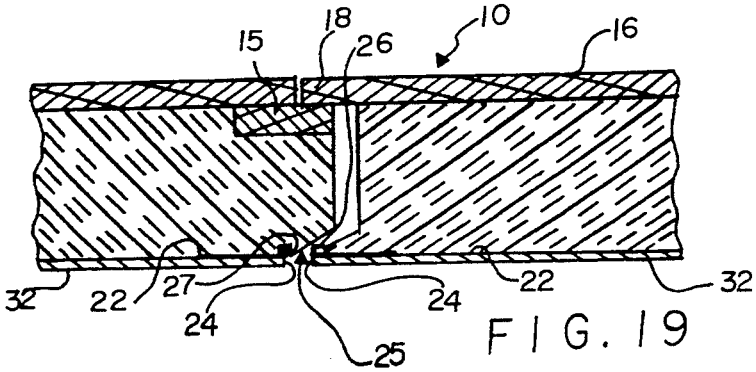
FIG. 19 is yet another embodiment of the subject joint illustrating the use of a hard board or other laminate on the interlock side of the core.

The further alternative embodiment building panel 10''' shown in FIG. 19 has a joiner 15''' overlying the core 14''' and edge extension 11''' and edge recess 12''' just the same as the other embodiments. The overlap recess 21''' is the same. The interlock snap lock assembly 25''' has a press 26''' and groove 27''' as well. Where the third embodiment panel 10''' differs from the earlier embodiments is in the utilization of a strip 22 which is laminated underneath a hard board or other interior laminate 23. In this fashion the adjoining ends 24 of the paneling 23 abut when the joint is completed and give the appearance of a seam in a well-executed wallpaper or laminated interior effect. The laminate 23 is just as desirable for the underside of a roof as it can be for an interior wall, particularly when the exterior composite skin 16''' is going to be shingled or otherwise covered with siding. In all instances where reference is made to the sheet or composite skin 31, 32 the strip 22 is to be considered an equivalent type member.

Figure 5:
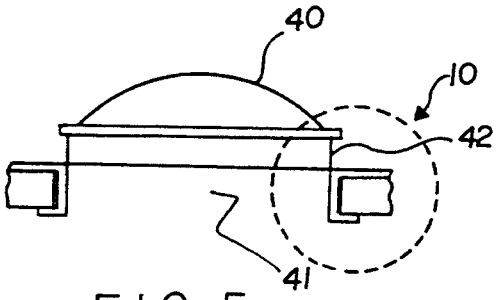
FIG. 5 illustrates, in cross-section, the utilization of the present panel and its shear rails to accommodate a skylight.
Figure 6:
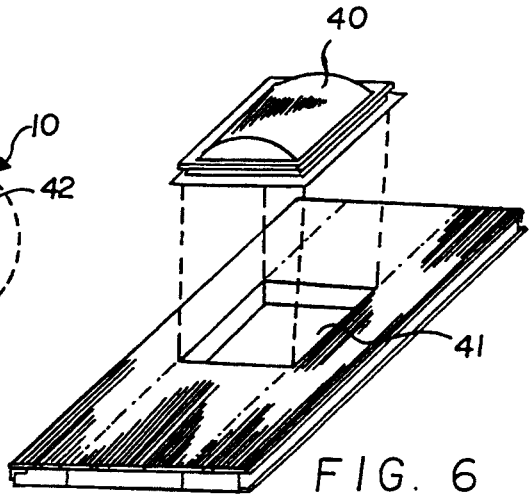
FIG. 6 is an exploded perspective view of an illustrative panel and the removed skylight.

A further option illustrating the versatility of the present invention evolves from the utilization of a panel with a drop-in skylight as shown in FIGS. 5 and 6. There it will be seen that the drop-in skylight 40 is received by an opening 41 in the panel 10. A pair of shear rails 30 are provided to flank the opening and give support to the skylight so that the skylight itself substitutes for the strength factor of the panel at the opening.

Figure 10:
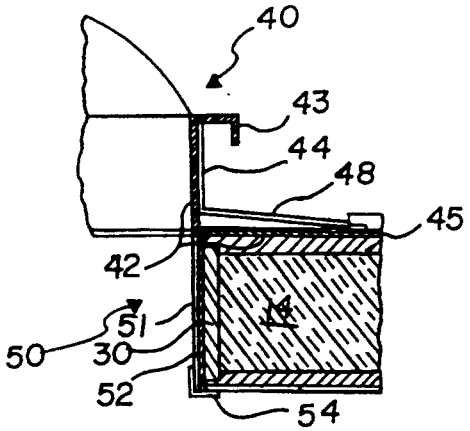
FIG. 10 is an enlarged view taken at fragments 10 encircled in FIG. 5. It shows details of the relationship between the skylight framing and the roof panel to insure a water-tight insertion.

Greater details of the skylight joint will be shown in FIG. 10 where it will be seen that the skylight 40 is provided with a skylight frame 43 around its periphery. The skylight frame 43, in turn, overlies the metal skylight receiving frame 42 at its reversely folded upper corner which, in turn, extends downwardly and underneath the structure and flashing onto the upper portion of the panel 10. Traditional builder's roofing felt 45 is applied to the upper portion of the panel 10, and finished off with the skylight shingle 48. A skylight box 50 is fashioned for dropping into the skylight hole 41 and comprises an aluminum sheet 51 of exterior materials secured to a preferably hard board base 52 which, in turn, is adjacent the shear rail 30. To finish the installation, an L-shaped molding is provided at the lower periphery of the hole 41 to mask the joining elements at the lower corner of the hole 41.

Figure 7:
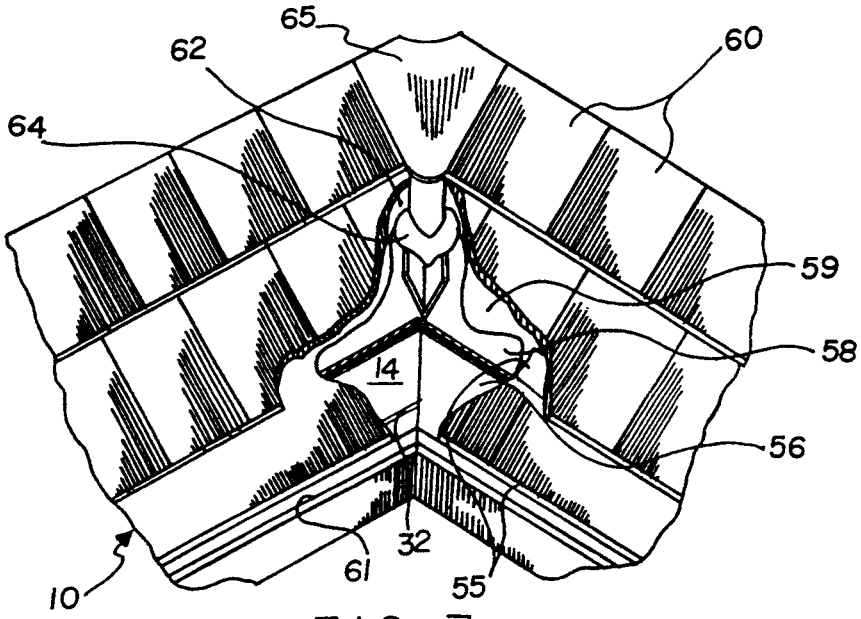
FIG. 7 is a perspective partially broken view of the joint between the roof of the panels of the present invention and a pre-existing structure taken essentially along the bullseye view shown by way of the reference numeral 7 in FIG. 1.

The advantageous employment of the subject invention in a room addition is illustrated in detail in FIGS. 6 and 7. Turning now to FIG. 6, it will be seen that, to the right, there is an existing metal gutter 55 which is over the existing wood facia 56. Therebeneath is the existing plywood sheathing 58, and on top of it is the existing roof felt 59 covered by the existing roof shingles 60. Turning to the left-hand portion of the same Figure, the new gutter 61 is secured in doubled relationship to the old gutter 55, in order to present continuity. The underneath skin 32 of the panel 10 is identified, as well as the core 14 of the panel 10. The composite material of the panel 10 is thereatop. Above that is the new roof felt 62 and the new fiber flashing 64 plus the new shingles 65. The new shingles include an additional gutter which forms the gutter to be described hereinafter.

The roof valley construction is shown in FIG. 8. On the right-hand side identifies the existing roof joist 70, the existing plywood sheathing 71, the existing roof felt overlay 72, and the pre-existing roof shingles. These all terminate in the gutter shingles 75.

On the left-hand side, it will be noted that there is an aluminum extrusion receiving channel 76, engaging the panel 10 at its lower end portion, and fabric flashing 78 forming the U-shaped curve of the gutter valley. On top of the fabric flashing 78 are new asphalt or fiberglass shingles 65 positioned further on top of the roofing felt. The panel 10 is illustrated as having a 7/16" OSB surface, EPS foam 3" core, and an aluminum skin therebeneath of between 0.019" and 0.032".

Figure 13:
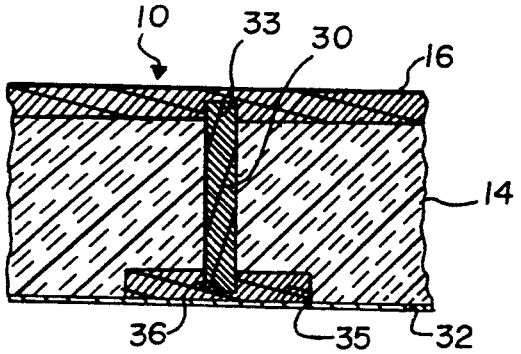
FIG. 13 is an enlarged view of the shear rail in the option shown in FIG. 4 adjacent the reference numeral 12.
Figure 14:
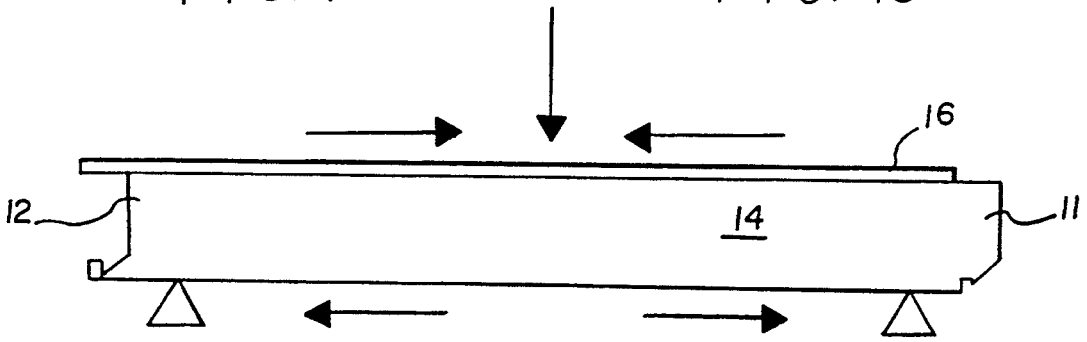
FIG. 14 is a diagrammatic cross-section of the subject panel illustrating its beam load characteristics.

A unique result occurs in beam loading of the present panel as is set forth in diagrammatic form in FIG. 13. Traditionally, a beam supported at both ends will deflect (sometimes almost undetectably) at a mid-portion of a load is applied to the mid-portion. Once the load is applied, which can be part of the tare weight of the panel 10, the upper portion goes into compression as shown by the arrows in FIG. 13, and the lower portion goes in to tension. In the present embodiment, the lower portion opposite the composite skin is desirably metallic and laminated to the core which thereby insures that the lower and most exterior portion of the panel 10 has a tension member stretching through its entire length. As a result of this compression/tension structure on the panel itself, significantly longer unsupported spans may be employed. Moreover, the overlap 18 compressively engages the joiner 15 when span deflection occurs further forming the joint. To accommodate expansion and contraction, a joiner gap 19 (see FIGS. 2 and 11) of one-eighth inch to one-quarter inch between the abutting edges of adjacent OSB panels is desirable. In this connection it should be remembered that once shingling and tar paper is applied, this adds two and one half pounds per square foot and the OSB or composite skin would be approximately one pound per square foot. Hence a linear length of ten feet has a total load of thirty five pounds per one foot wide section. For a four foot wide section, the amount is one hundred forty pounds. Nonetheless, the additional compression/tension relationship between the opposed outer surfaces will offset this loading and an insulated panel which has lateral edges which are essentially leak proof, but rendered as leak proof as a normal roof as soon as the roofing is applied on the top.

Not to be overlooked is the application of the subject building panel 10 in the wall construction as shown on the ends of the room addition 4 in FIG. 1. There the composite skin 16 is desirably on the interior portion of the building. It can then be the subject of overlapping drywall, or decorator panels, or other finishing techniques. Indeed, many prefer to leave the OSB in its natural form after sanding and coating with a urethane-type clear covering. The composite skin also provides means for securing shelving, utilities, and a whole host of other applications to the interior wall.

In manufacture, a small groove 80 as shown in FIGS. 2, 3, 4, 9 and 11 is provided in the upper portion of the edge extension 11 opposite where the groove 27 appears. In manufacturing this permits visual line-up of the composite skin 16 so that the interlocking joint 25 will be substantially opposite the joint between the joiner 15 and the overlap 18 of the lateral panel adjacent the same edge.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A building panel comprising, in combination, a central essentially rectangular core of material having lateral edges, ends, and opposed first and second faces, said core having a male edge extension on a first lateral edge and a female recess on a second lateral edge, a formed skin having a first snap fit interlocking member one of two lateral edges of the formed skin overlying the male extension of the core material, a second snap fit interlocking member formed at the second lateral edge of said skin and extending from the skin adjacent the second lateral edge of the core for mating engagement with the said first interlocking member on an adjacent panel, a sheet of composite skin material overlying the core second face, a recess in the core material overlying the male extension of the core and extending beneath said composite sheet material, a nailable joiner running beneath said composite sheet material within said recess and extending outwardly over the male edge extension, an extension of said composite skin material extending beyond the core at one lateral edge of the core female recess, said extension being proportioned to overlie the joiner on an adjacent panel formed substantially identical as said building panel.

2. In the building panel of claim 1, a shear rail positioned at a mid-position in the core, and a perpendicularly oriented base for said rail engaging the formed skin to thereby form with the shear rail, and opposed substrate, an I-beam like configuration to strengthen the panel against bending in an unsupported length.

3. A building panel comprising, in combination, a central essentially rectangular core of material having insulating and structural properties and lateral edges, opposed first and second faces, and opposed ends, a formable skin having lateral edges and secured to the core along the first face of said core, the lateral edges of said formable skin having interlocking edges adapted for engagement with an adjacent building panel of the same construction to form a snap interfitting type joint, a female recess formed in the core on one lateral edge, a male extension portion on the opposite lateral edge of said core formed to nestingly fit within the recess of an adjacent panel, a shear rail positioned at a mid-position of the subject core and flanked by the core, a footer for said shear rail positioned perpendicular to the shear rail and coplanar with the core and the skin, and a structural sheet nailable material overlying and laminated to the core second face and extending beyond the female recess forming a female extension to overlap the adjacent central core male extension, and a back cut at the opposite lateral edge away from the male extension to abuttingly engage and receive the extending structural panel extension from an adjacent panel, a recess in the core material overlying the male extension of the core and extending beneath said composite sheet material, a nailable joiner running beneath said composite sheet material within said recess and extending outwardly over the male edge extension.

4. In the building panel of claim 3, said formable skin having a channel-like member at one edge of said formable skin, a channel insertion member formed at the opposite edge of said skin and extending toward the opposite face of the core for mating engagement with a channel like member on an adjacent panel to form a snap interfitting type joint.

5. In the building panel of claim 3, said shear rail located between the edges of the core and extending between the ends of the core and perpendicular with the sheet of nailable material and having a footer perpendicular therewith and positioned adjacent the core and having a male extension.

6. In the building panel of claim 3, a shear rail positioned adjacent the recess portion of the core and abuttingly engaging the sheet of nailable material at one end, and having a footer perpendicular therewith at the end opposite the sheet of nailable material, said footer having opposed faces, one of which abuts the skin, and the other of which abuts the shear rail.

7. In the building panel of claim 3, a drop-in skylight proportioned for mounting between the shear rails.

8. A building panel comprising, in combination, a central essentially rectangular core of material having lateral edges, ends, and opposed first and second faces, one lateral edge having a male extension and the other lateral edge having a female recess, a formed skin having lateral edges and secured to the first face of the core, said formed skin having a first snap acting interlocking member at one edge of said formed skin overlying a male extension of the core material, a second snap acting interlocking member formed at the opposite first interlocking edge of said skin and extending toward the opposite face from the skin for mating engagement with the first interlocking member on an adjacent panel, a recess in the core material overlying the male extension of the core, a joiner positioned within said recess and opposite said interlocking members, a sheet of composite skin material overlying the core second face, an extension of said composite skin material extending beyond the core at one lateral edge of the core female recess, said extension being proportioned to overlie the joiner on an adjacent panel formed substantially identical as said building panel.

9. A building panel, in combination, a central essentially rectangular core of insulating material having lateral edges one having a male extension and one having a female recess opposed first and second faces, and ends, a formable skin having lateral edges and secured to the core along said first face, said formable skin at the edges of said skin intended for engagement to an adjacent like building panel having snap acting interlocking elements for engaging an adjacent like panel interlocking element, parallel shear rails positioned at a mid-position of the core and flanked by the core, a structural sheet of nailable material overlying and laminated to the core second face and extending at one edge of said sheet to overlap the adjacent central core, a back cut at the opposite lateral edge of said sheet to abuttingly engage and receive the extending structural sheet from an adjacent panel, a joiner beneath said structural sheet of nailable material lateral edges and opposite the snap acting interlocking elements, and means defining a skylight mounting recess between said parallel shear rails.

* * * * *